US005385136A

United States Patent [19]

Thomas

[11] Patent Number: 5,385,136

[45] Date of Patent: Jan. 31, 1995

[54] IMPULSE STABALIZER CAPABLE OF ASYMMETRICAL RESPONSE

[75] Inventor: Bruce A. Thomas, Swartz Creek, Mich.

[73] Assignee: Archery Dynamics, Inc., Swartz Creek, Mich.

[21] Appl. No.: 107,985

[22] Filed: Aug. 16, 1993

[51] Int. Cl.[6] ..... F41B 5/20

[52] U.S. Cl. ..... 124/89; 188/378

[58] Field of Search ..... 124/89; 42/1.06; 188/317, 322.15, 378; 267/136, 137

[56] References Cited

U.S. PATENT DOCUMENTS

| | | | |
|---|---|---|---|
| 3,683,534 | 8/1972 | Davis | 42/1.06 |
| 4,245,612 | 1/1981 | Finlay | 124/89 |
| 4,279,091 | 7/1981 | Edwards | 42/1.06 |
| 4,310,149 | 1/1982 | Camilleri | 257/136 |
| 4,893,606 | 1/1990 | Sisko | 124/89 |
| 4,945,666 | 8/1990 | Henry | 42/1.06 |
| 4,982,719 | 1/1991 | Haggard et al. | 124/89 |
| 4,986,018 | 1/1991 | McDonald | 42/1.06 |
| 5,044,351 | 9/1991 | Pfeifer | 124/89 |

*Primary Examiner*—Eric K. Nicholson
*Assistant Examiner*—John A. Ricci
*Attorney, Agent, or Firm*—James C. McLaughlin

[57] ABSTRACT

The preferred embodiment of an impulse stabilizer for reducing the effects of a mechanical impulse produced by apparatus including archery bows or air-rifles comprises a sealed elongated housing containing along its axis from one end to the other: a first cushion; a first mass that is elongated, contains an axial hole, is surrounded with one or more bushings, and that only loosely fits within the housing; a coil type spring under compression; a second mass that is the same as the first mass except that its length, density, or hole cross-section area may be different; and a second cushion. The voids within the housing are essentially filled with a fluid such as hydraulic fluid. The dimensions are such that, at rest, the spring urges both masses against their adjacent cushions. When the stabilizer is subjected to an impulse, one mass moves away from its adjacent cushion against its inertia, the restorative force of the spring, and the damping of the fluid flowing through its hole and around its periphery in such a manner as to reduce the effects of the impulse. An impulse in the opposite direction similarly activates the other mass. Both masses are similarly affected by the spring. However, since they may differ in mass and may offer differing resistance to the fluid, the response may be different depending on the direction of an impulse. An alternate embodiment optionally does not use cushions, bushings, or holes.

4 Claims, 1 Drawing Sheet

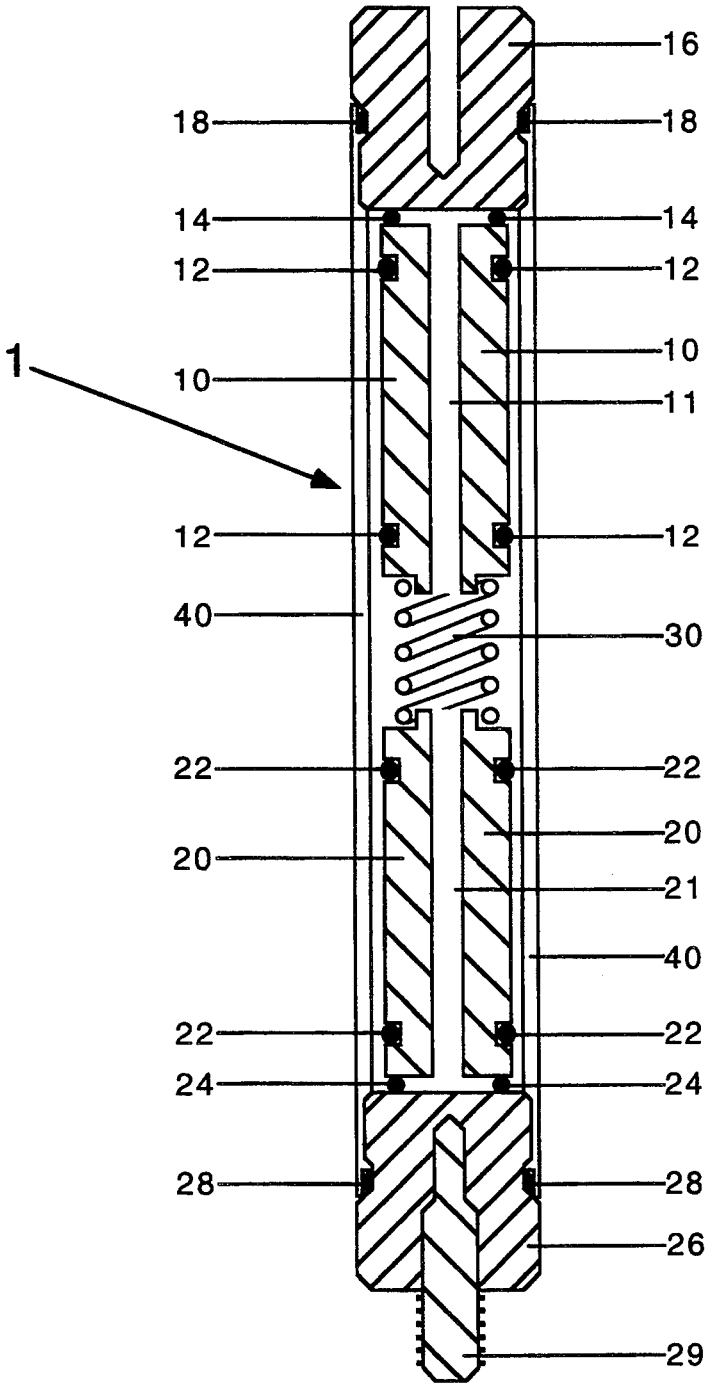
16
18
18
14
14
12
12
1
10
10
11
12
12
40
30
22
22
20
20
21
40
22
22
24
24
28
28
26
29

IMPULSE STABALIZER CAPABLE OF ASYMMETRICAL RESPONSE

TECHNICAL FIELD OF THE INVENTION

The technical field of the present invention is that of stabilizers used to stabilize mechanical, impulse-producing devices (such as, but not limited to, archery bows, air rifles, and firearms) against the impulse resulting from the launching of a projectile (such as an arrow, pellet, or bullet). More particularly, the technical field of the present invention is that of stabilizers capable of having asymmetrical response characteristics so that the reaction in one direction can be different from the reaction in the other direction.

BACKGROUND INFORMATION

Various stabilizers are known in the art. One type of stabilizer is represented by the device of U.S. Pat. No. 4,982,719 wherein a single mass in the form of a single, tightly-fitting piston is restrained within a hydraulic-fluid-containing-cylinder by conical springs at each end of the piston. A central passage through the piston, and O-rings about the periphery of the piston, causes hydraulic fluid only to flow within the central passage. Radial holes extend from the outer periphery of the piston into the central passage of the piston. Though it is contended that the expense and complexity of producing the radial holes facilitates lubrication and smooth movement of the piston, it is expected that a piston fitting so tightly as to have no fluid flow at its periphery will encounter uneven wall friction and thus inconsistent performance. Wall friction will cause wear of the O-rings and result in changes in the frictional response of the piston. It is also expected that for the piston to be able to move without fluid flow at its periphery, the inside of the cylinder and the piston must have a very accurate fit. Such a device, at best, has the same response in both directions, requires high precision and effort in its manufacture, is expected to have inconsistent performance, and to have a limited life.

Another class of stabilizer is represented by the device in U.S. Pat. No. 5,016,602 wherein a cylinder is partially filled with granular solids that can move back and forth to dissipate some of the energy of an applied impulse. It is also known to use a viscus fluid (such as mercury) within a cylinder to effect a similar result. Such devices tend to have good service life but are limited in adjustment.

Known devices are generally cylindrical or elongated (and thus tend to have similar external appearances) and are expected inherently to have essentially the same response in both directions. Accordingly, an object of the present invention is a stabilizer capable of damping a mechanical impulse in one direction with a different amount of mass and damping than in the opposite direction.

A more particular object of the present invention is a stabilizer that is relatively inexpensive and easy to construct, having few parts that are either simple to make or are stock items. Additionally, an object is ease of varying the response merely by changing the density or length of a part or the size of a hole. It is also an object to provide optional means for the operation of the present invention to take place quietly. Lastly, it is an object to have a device having consistent performance over a long service life.

SUMMARY OF THE INVENTION

The foregoing and other objects and advantages are achieved with the apparatus disclosed below. The apparatus of the preferred embodiment of the present invention comprises a sealed, elongated, cylindrical housing containing from one end to the other: a first cushion; a first mass that is elongated, contains an axial hole (orifice) that extends completely through the mass, is surrounded with one or more bushings, and that only loosely fits within the housing; a coil type spring under compression; a second mass that is the same as the first mass except that its length, density, or hole cross-section area may be different; and a second cushion. The voids within the housing are essentially filled with a fluid such as hydraulic fluid. The dimensions are such that, at rest, the spring urges both masses against their adjacent cushions.

The preferred embodiment of the present invention uses cushions placed against the ends of the housing (so as to be interposed between an end of the housing and a mass) mainly to attenuate the sound that could occur when a mass strikes an end of the housing. The preferred embodiment of the present invention uses one or more bushings surrounding a mass mainly to attenuate the sound of a mass striking the walls of the housing. Cushions or bushings also reduce the tendency of a mass to become deformed or the inside of the housing to become scored, and thus the use of cushions or bushings also tends to extend the useful life of the apparatus and the consistency of performance. Since the masses with their bushings only loosely fit within the housing, flow of any fluid such as air or hydraulic fluid is expected around the periphery of the masses.

While the preferred embodiment of the present invention uses cushions, bushings, and holes (as herein described), the apparatus of the present invention does not require these attributes in order to perform its desirable function of stabilizing mechanical impulses. The present invention encompasses an elongated housing containing two, possibly dissimilar, loosely fitting masses separated by a spring (or its equivalent) that urges the masses to the ends of the housing when the present invention is at rest and that opposes the displacement of a mass when the present invention is subjected to an impulse. A stabilizer as just described is particularly useful at very high and very low temperatures. The present invention also encompasses the possibility of essentially filling the housing with a fluid other than air. Since the masses only loosely fit within the housing, the masses and housing can be made of abrasion and impact resistant material, and the spring can be operated distant from its yield point. It is apparent that the present invention is inexpensive to make and will have a long, consistent service life.

In operation, the apparatus of the present invention is affixed to an impulse producing device with the axis of the present invention extending in essentially the same direction as the expected impulse. When the present invention is subjected to an impulse: one mass moves away from its adjacent cushion (if any) against its inertia, against the restorative force of the spring, and against the damping of fluid flowing through its hole (if any) and around its periphery, in such a manner as to reduce the effects of the impulse. An impulse in the opposite direction similarly activates the other mass. Both masses are similarly affected by the spring. However, since they may differ in mass and (because of differing cross-sections) may offer differing resistance to movement through the fluid, it follows that the response of the present invention may be different depending on the direction of an impulse. The cross-sections of the masses of the preferred embodiment are adjusted by varying the looseness of a mass's fit within the housing or by varying the diameter of the axial hole that extends through a mass. The preferred embodiment may be "tuned" for optimum performance independently in each of two directions by changing the mass (inertia) and cross-section (resistance or drag) of each mass separately.

BRIEF DESCRIPTION OF THE DRAWINGS

The FIGURE is a side view of the preferred embodiment of the present invention that has been sliced in half along its axis

DETAILED DESCRIPTION OF THE INVENTION AND ITS PREFERRED EMBODIMENT

The FIGURE shows in cross section the components of the preferred embodiment of the present invention's stabilizer 1. (The components of the preferred embodiment of the present invention are symmetrical about the central axis.) Elongated housing 40 is sealed at its ends by first end cap 16 (assisted in the preferred embodiment by first O-ring 18 compressed between elongated housing 40 and first end cap 16) and second end cap 26 (assisted in the preferred embodiment by second O-ring 28 compressed between elongated housing 40 and second end cap 26). In the preferred embodiment, second end cap 26 is supplied with threaded stud 29 to facilitate attachment to an impulse producing apparatus.

Within elongated housing 40 (of the preferred embodiment) are contained: first cushion 14 interposed between first end cap 16 and first mass 10; spring 30 interposed between first mass 10 and second mass 20; and second cushion 24 interposed between second mass 20 and second end cap 26. Voids within elongated housing 40 are essentially filled with a fluid (not shown, nor readily capable of being shown, on the FIGURE). First mass 10 has one or more first bushings 12 placed on its perimeter to attenuate sound produced when first mass 10 collides with the walls of elongated housing 40. In the same manner and to the same purpose, second mass 20 has one or more second bushings 22. Both first mass 10 and second mass 20 are loosely contained within elongated housing 40 and may differ in size or density so as to effect different inertial forces. First axial hole 11 is placed through first mass 10 with a cross section (in conjunction with the gap between first bushings 12 and the inside wall of elongated housing 40) designed to produce a desired frictional damping. In the same manner and to the same purpose, second mass 20 has second axial hole 21. The cross sections (and thus the resultant friction) of first axial hole 11 may differ from that of second axial hole 21.

In the preferred embodiment, the fluid is hydraulic fluid. In the preferred embodiment, first bushing 12, second bushing 22, first cushion 14, and second cushion 24 are made of neoprene, but could be made of other relatively soft resilient material. In the preferred embodiment, first mass 10 and second mass 20 are cylindrical, have a flange that assists spring 30 to remain approximately centered and in contact with the two masses, and nave cylindrical axial holes.

An alternate embodiment would not contain one or both of the cushions of the preferred embodiment, would not contain some or all of the bushings of the preferred embodiment, or would not contain one or both holes of the preferred embodiment. Such an alternate embodiment comprises (in its most simple form) a sealed, elongated housing with a first end and a second end; a first mass loosely and slidably received within the housing and adjacent to its first end; a second mass loosely and slidably received within the housing and adjacent to its second end; and a spring means interposed between the two masses for urging the masses against their adjacent housing-ends when the stabilizer is at rest and for opposing the displacement of a mass when the stabilizer is subjected to an impulse.

The preferred embodiment and an alternate embodiment of the present invention have been described in detail. The embodiments described are illustrative and not restrictive.

I claim:

1. An impulse stabilizer comprising:

a sealed, elongated housing with a first end and a second end;

a first mass loosely and slidably received within said housing and adjacent to said first end;

a second mass, dissimilar from said first mass, loosely and slidably received within said housing and adjacent to said second end; and a spring means interposed between said first mass and said second mass for urging said masses against their adjacent housing-ends when the stabilizer is at rest and for opposing the displacement of a said mass when the stabilizer is subjected to an impulse.

2. An impulse stabilizer comprising:

an elongated housing with a first end and a second end;

a first end cap sealing said first end;

a first means for cushioning placed within said housing and against said first end cap;

a first mass loosely received within said housing and adjacent to said first means for cushioning;

a second end cap sealing said second end;

a second means for cushioning placed within said housing and against said second end cap;

a second mass, dissimilar from said first mass, loosely received within said housing and adjacent to said second means for cushioning; and a spring means interposed between said first mass and said second mass for urging said masses against their adjacent means for cushioning when the stabilizer is at rest and for opposing the displacement of a said mass when the stabilizer is subjected to an impulse.

3. An impulse stabilizer comprising:

a sealed, elongated housing with a first end and a second end;

a first mass loosely and slidably received within said housing and adjacent to said first end;

one or more bushings surrounding said first mass;

a second mass loosely and slidably received within said housing and adjacent to said second end; and a spring means interposed between said first mass and said second mass for urging said masses against their adjacent housing-ends when the stabilizer is at rest and for opposing the displacement of a said mass when the stabilizer is subjected to an impulse.

4. An impulse stabilizer as described in claim 3 further including one or more bushings surrounding said second mass.

* * * * *